US006105543A

United States Patent [19]

Ogawa

[11] Patent Number: 6,105,543

[45] Date of Patent: Aug. 22, 2000

[54] VALVE TIMING CONTROL DEVICE

[75] Inventor: Kazumi Ogawa, Toyota, Japan

[73] Assignee: Aisin Seiki Kabushiki Kaisha, Aichi-pref., Japan

[21] Appl. No.: 09/218,030

[22] Filed: Dec. 22, 1998

[30] Foreign Application Priority Data

Dec. 24, 1997 [JP] Japan ..... 9-355869

[51] Int. Cl.[7] ..... F01L 1/344; F01L 13/00

[52] U.S. Cl. ..... 123/90.17; 123/90.31

[58] Field of Search ..... 123/90.15, 90.16, 123/90.17, 90.31; 74/568 R; 464/1, 2, 160

[56] References Cited

U.S. PATENT DOCUMENTS

| | | | |
|---|---|---|---|
| 5,738,056 | 4/1998 | Mikame et al. | 123/90.17 |
| 5,775,279 | 7/1998 | Ogawa et al. | 123/90.17 |
| 5,797,361 | 8/1998 | Mikame et al. | 123/90.17 |
| 5,865,151 | 2/1999 | Fukaya et al. | 123/90.17 |
| 5,941,203 | 8/1999 | Sato | 123/90.17 |
| 5,943,989 | 8/1999 | Kira | 123/90.17 |

FOREIGN PATENT DOCUMENTS

| | | |
|---|---|---|
| 1-92504 | 4/1989 | Japan . |
| 2-50105 | 4/1990 | Japan . |
| 9-60508 | 3/1997 | Japan . |
| 9-280017 | 10/1997 | Japan . |

*Primary Examiner*—Weilun Lo
*Attorney, Agent, or Firm*—Reed Smith Hazel & Thomas LLP

[57] ABSTRACT

A valve timing control device comprising a valve opening and closing rotary shaft assembly rotatably assembled within a cylinder head of an internal combustion engine, a rotational transmitting member mounted around the peripheral surface of the rotary shaft assembly so as to rotate relative thereto within a predetermined range for transmitting a rotational power from a crank shaft, a vane provided on one of the rotary shaft assembly and the rotational transmitting member, a chamber formed between the rotary shaft assembly and the rotational transmitting member, and divided into an advancing chamber and a delaying chamber by the vane, a first fluid passage for supplying and discharging a fluid to and from the advancing chamber, a second fluid passage for supplying and discharging a fluid to and from the delaying chamber, a refuge hole formed in one of the rotational transmitting member and the rotary shaft assembly for accommodating therein a locking pin spring-biased toward the other of the rotary shaft assembly and the rotational transmitting member, a fitting hole formed in the other of the rotary shaft assembly and the rotational transmitting member for fitting therein a head portion of the locking pin when the rotary shaft assembly and the rotational transmitting member are synchronized in predetermined relative phase, a third passage for supplying and discharging a fluid to and from the fitting hole, a pressure back chamber formed in the refuge hole at the back of the locking pin is given communication with the inside of the cylinder head of the internal combustion engine via a communication passage formed in the rotational transmitting member or the rotary shaft assembly, and closing means for closing the communication passage when the head portion of the locking pin moves into the refuge hole by the fluid supplied to the fitting hole via the third passage.

3 Claims, 4 Drawing Sheets

VALVE TIMING CONTROL DEVICE

The present invention relates to a valve timing control device and, in particular, to the valve timing control device for controlling an angular phase difference between a crank shaft of a combustion engine and a cam shaft of the combustion engine.

BACKGROUND OF THE INVENTION

In Unexamined Published Japanese Patent Application (Kokai) No. Hei 1-92504or Unexamined Published Japanese Utility Model Application (Kokai) No. Hei 2-50105, for example, there is disclosed a valve timing control device comprising: a rotational transmitting member mounted around a valve opening and closing rotary shaft assembly (including a cam shaft and an internal rotor integrally mounted on the cam shaft) rotatably assembled with the head of an internal combustion engine so as to rotate relative thereto within a predetermined range for transmitting rotating power from a crank pulley; vanes provided on the rotary shaft assembly; fluid chambers formed between the rotary shaft assembly and the rotational transmitting member and halved into advancing chambers and delaying chambers by the vanes; first fluid passages for supplying and discharging a fluid to and from the advancing chambers; second fluid passages for supplying and discharging the fluid to and from the delaying chambers; a refuge hole formed in the rotational transmitting member and accommodating therein a locking pin spring-biased toward the rotary shaft assembly; a fitting hole formed in the rotary shaft assembly for fitting therein a head portion of the locking pin when the rotary shaft assembly and the rotational transmitting member are synchronized in predetermined relative phases; and a third passage for supplying and discharging the fluid to and from the fitting hole.

The valve timing control device, as described in each of the above-cited patent applications is constructed such that the locking pin is moved against the spring-urging force by the fluid supplied to the fitting hole via the third fluid passage. In the case where the fluid supplied to the fitting hole partially leaks through the clearance between the refuge hole and the locking pin to the back pressure chamber accommodating a spring for urging the locking pin, the back pressure chamber may be vented to the atmosphere such that the fluid may be discharged therefrom.

Here, the fluid to be used in the device is a working oil. When the rotating power from the crank pulley is transmitted through a timing chain to the rotational transmitting member, the working oil to be discharged from the back pressure chamber can be employed as the oil for lubricating the timing chain. When the rotating power is transmitted through a timing belt made of a resin or rubber, the working oil may cause a slipping engagement between the timing belt and the rotational transmitting member, or deteriorate the timing belt.

SUMMARY OF THE INVENTION

The invention has been conceived to solve the above-specified problems. According to the invention, there is provided a valve timing control device comprise a valve opening and closing rotary shaft assembly rotatably assembled within a cylinder head of an internal combustion engine, a rotational transmitting member mounted around the peripheral surface of the rotary shaft assembly so as to rotate relative thereto within a predetermined range for transmitting a rotational power from a crank shaft, a vane provided on one of the rotary shaft assembly and the rotational transmitting member, a chamber formed between the rotary shaft assembly and the rotational transmitting member, and divided into an advancing chamber and a delaying chamber by the vane, a first fluid passage for supplying and discharging a fluid to and from the advancing chamber, a second fluid passage for supplying and discharging a fluid to and from the delaying chamber, a refuge hole formed in one of the rotational transmitting member and the rotary shaft assembly for accommodating therein a locking pin spring-biased toward the other of the rotary shaft assembly and the rotational transmitting member, a fitting hole formed in the other of the rotary shaft assembly and the rotational transmitting member for fitting therein a head portion of the locking pin when the rotary shaft assembly and the rotational transmitting member are synchronized in predetermined relative phase, a third passage for supplying and discharging a fluid to and from the fitting hole, a back pressure chamber formed in the refuge hole at the back of the locking pin in communication with the inside of the cylinder head of the internal combustion engine via a communication passage formed in the rotational transmitting member or the rotary shaft assembly, and closing means for closing the communication passage when the head portion of the locking pin moves into the refuge hole by the fluid supplied to the fitting hole via the third passage.

In the valve timing control device according to the invention, the fluid, having leaked into the back pressure chamber through the clearance between the refuge hole and the locking pin, can be discharged to the inside of the cylinder head via a communication passage. As a result, the fluid can be prevented from wetting the timing belt thereby suppressing poor engagement between the rotational transmitting member and a timing belt and the premature deterioration of the timing belt even if the timing belt is made of a resin or rubber and adopted as means for transmitting the rotating power from a crank pulley to the rotational transmitting member. Since no fluid under pressure is supplied to the inside of the back pressure chamber, neither a malfunction of the locking pin nor a fine vibration of the locking pin occurs. In addition, in the valve timing control device according to the invention, when the head portion of the locking pin moves into the refuge hole, the closing means closes the communication between the inside of the back pressure chamber and the inside of a cylinder head of the internal combustion engine so as to obtain a damper effect at the back pressure chamber. Therefore, when the combustion engine rotates, the moving speed of the locking pin toward the fitting hole becomes slow so that the head portion of the locking pin can be prevented from inserting into the fitting hole.

Other objects and advantages of invention will become apparent during the following discussion of the accompanying drawings.

BRIEF DESCRIPTION OF THE DRAWINGS

The foregoing and additional features of the present invention will become more apparent from the following detailed description of an embodiment thereof when considered with reference to the attached drawings, in which:

FIG. 4 is a view similar to FIG. 2 but shows a state in which the internal rotor and the vanes are slightly rotated clockwise from the state of FIG. 2 relative to the external rotor and so on;

FIG. 6 is a view similar to FIG. 4 but shows a state in which the internal rotor and vanes are rotated clockwise to a predetermined extent from the state of FIG. 4 relative to the external rotor and so on.

DETAILED DESCRIPTION OF THE PREFERRED EMBODIMENTS

A valve timing control device in accordance with a preferred embodiment of the present invention will be described with reference to the attached drawings.

Figure 1:
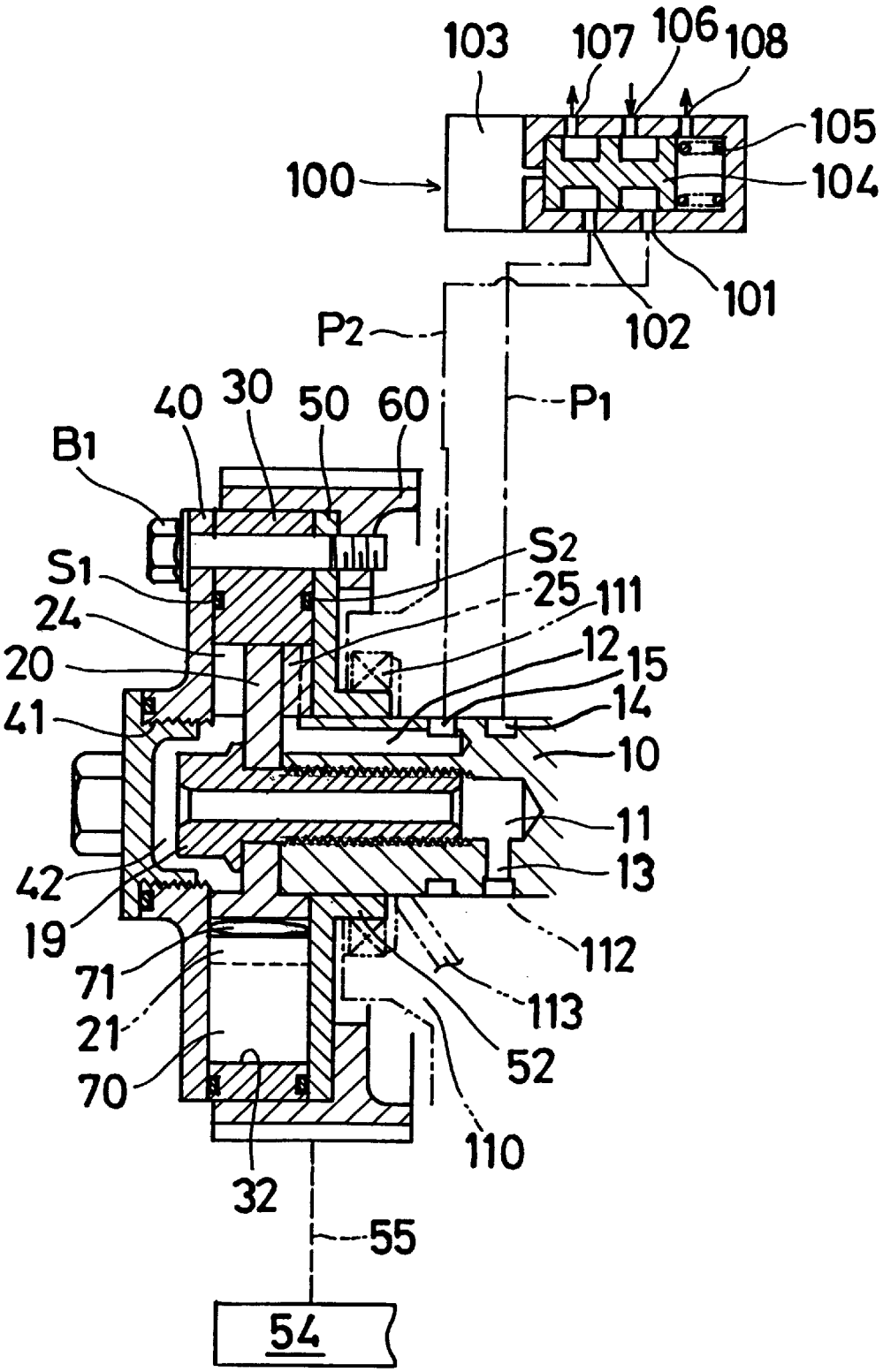
FIG. 1 is a sectional view of the embodiment of a valve timing control device in accordance with the prevent invention.
Figure 2:
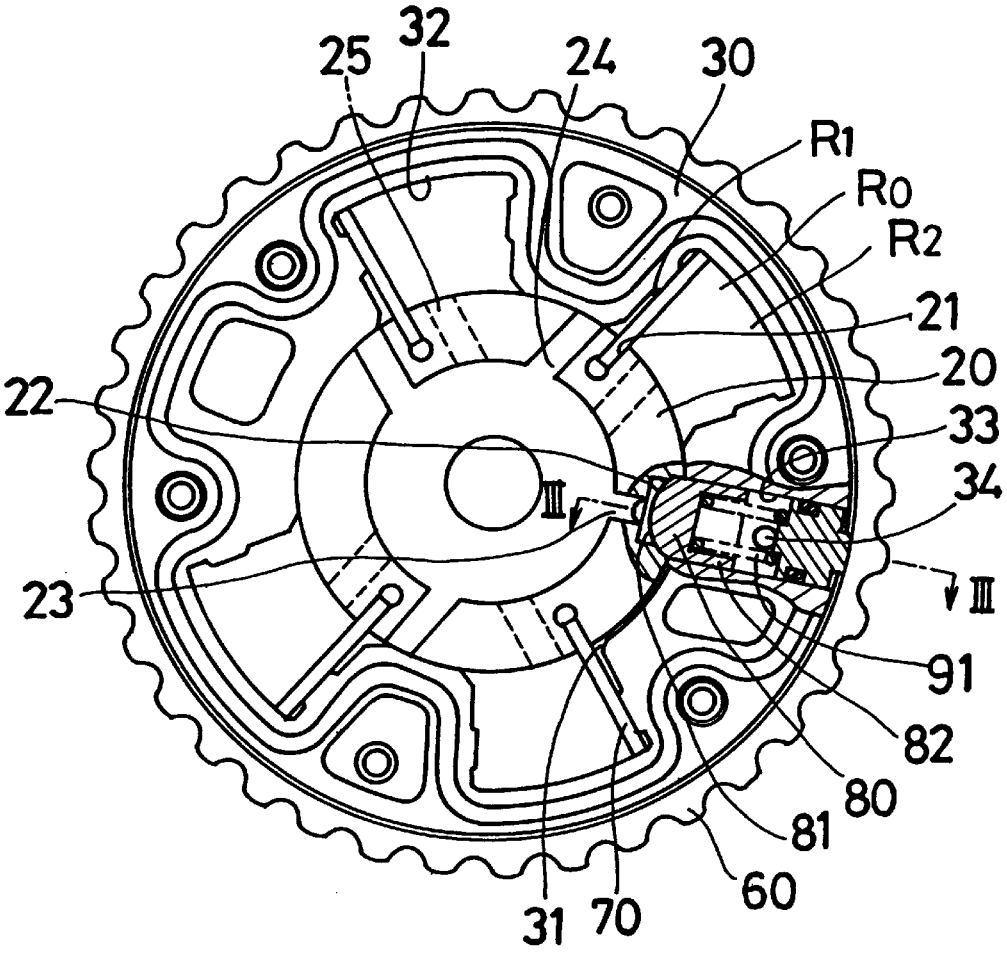
FIG. 2 is a partially broken front view showing the relationship among an internal rotor, an external rotor, vanes, a locking pin, a timing pulley and so on, as shown in FIG. 1.
Figure 3:
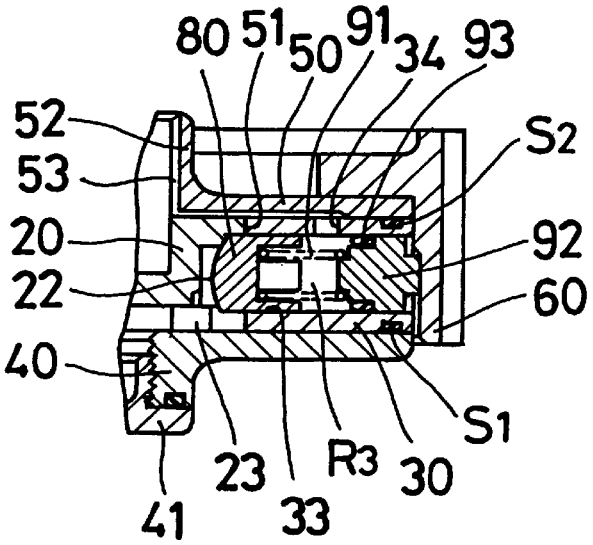
FIG. 3 is a section taken along the line III—III in FIG. 2.

A valve timing control device according to the present invention, as shown in FIGS. 1 to 3, is constructed so as to comprise a valve opening and closing shaft including a cam shaft 10 rotatably supported by a cylinder head 110 of an internal combustion engine, and an internal rotor 20 integrally provided on the leading end portion of the cam shaft 10; a rotational transmitting member mounted around the rotary shaft so as to rotate relative thereto within a predetermined range and including an external rotor 30, a front plate 40, a cup 41, a rear plate 50 and a timing pulley 60 which is integrally formed around the external rotor 30; four vanes 70 assembled with the internal rotor 20; and a locking pin 80 assembled with the external rotor 30. Here, the timing pulley 60 is constructed, as is well known in the art, to transmit the rotating power to the clockwise direction of FIG. 2 from a crank pulley 54 through a timing belt 55 of a resin or rubber.

The cam shaft 10 is equipped with a well-known cam (not shown) for opening and closing an intake valve or an exhaust valve (although both are not shown) and is provided therein with an advance passage 11 and a delay passage 12, which are extended in the axial direction of the cam shaft 10. The advance passage 11 is connected to a connection port 102 of a change-over valve 100 via a radial passage 13, an annular passage 14 and a connection passage P1. On the other hand, the delay passage 12 is connected to a connection port 101 of the change-over valve 100 via an annular passage 15 and a connection passage P2.

The change-over valve 100, as shown in FIG. 1, is enabled to move a spool 104 rightward of FIG. 1 against the action of a coil spring 105 by energizing a solenoid 103. The change-over valve 100 is so constructed as to establish, when deenergized, the communication between a feed port 106, as connected to an oil pump (not shown) to be driven by the internal combustion engine, and the connection port 101 and the communication between the connection port 102 and an exhaust port 107 and as to establish, when energized, the communication between the feed port 106 and the connection port 102 and the communication between the connection port 101 and an exhaust port 108. As a result, the working oil is supplied to the delay passage 12, when the solenoid 103 is deenergized, and to the advance passage 11 when the same is energized.

The internal rotor 20 is integrally fixed in the cam shaft 10 by means of a hollow bolt 19 and is provided with vane grooves 21 for providing the four vanes 70 individually in the radial directions. Further provided are a fitting hole 22 for fitting a head portion 81 of the locking pin 80 to a predetermined extent in the state shown in FIG. 2, where the cam shaft 10, the internal rotor 20 and the external rotor 30 are in synchronized phase (or the most delayed position) relative to one another; a passage 23 for supplying and discharging the working oil to and from the fitting hole 22 via the advance passage 11; passages 24 for supplying and discharging the working oil to and from advancing chambers RI (excepting that, as located at the right-hand lower one of FIG. 2), as defined by the individual vanes 70, via the advance passage 11; and passages 25 for supplying and discharging the working oil to and from delaying chambers R2, as defined by the individual vanes 70, via the delaying passage 12. To and from the advancing chamber R1 located at the right-hand lower position of FIG. 2, there is supplied and discharged the working oil from the fitting hole 22 via a passage 31 formed in the external rotor 30. The fitting hole 22 is stepped to have a larger diameter at its outer end portion for receiving the head portion 81 of the locking pin 80 such that the top of the head portion 81 abuts against the step. For this, the diametrically larger portion is chamfered at its outer end. Here, each vane 70 is urged radially outward by a spring 71 (as shown in FIG. 1) fitted in the bottom portion of the vane groove 21.

The external rotor 30 is assembled with the outer circumference of the internal rotor 20 so as to rotate relative thereto within a predetermined range. To the two sides of the external rotor 30, there are joined the front plate 40 and the rear plate 50 through seam members S1 and S2. The external rotor 30 is integrally joined to the internal rotor 20 together with the timing pulley 60 by means of a bolt B1. With the front plate 40, the cap 41 is assembled liquid-tight to form a passage 42 for connecting the advance passage 11 of the cam shaft 10 and the passages 23 and 24 of the internal rotor 20. In the external rotor 30, on the other hand, there are formed fluid pressure chambers R0 accommodating the individual vanes 70 and adapted to be halved into the advancing chambers R1 and the delaying chambers R2 by the individual vanes 70; and a refuge hole 33 formed in the radial direction of the external rotor 30 for accommodating the locking pin 80 and a spring 91 for urging the locking pin 80 toward the internal rotor 20.

The refuge hole 33 is closed liquid-tight at its outer end by a plug 92 and a seal member 93 to form a back pressure chamber R3 at the back of the locking pin 80. The back pressure chamber R3 is in communication with the inside of the cylinder head 110, as shown in FIGS. 2 and 3, via a communication hole 34 formed in the external rotor 30 and communicating with the back pressure chamber R3, a communication groove 51 (which can be exemplified by a communication hole) formed in the rear plate 50 and communicating with the commutation hole 34 at its radially outer end, a communication groove 53 (which can be exemplified by a communication hole) formed axially in the inner circumference of a boss portion 52 (i.e., the portion which is rotatably assembled at its inner circumference with the cam shaft 10 and engaging at its outer circumference with an oil seal 111 assembled with the cylinder head 110) of the rear plate 50, and a communication hole 113 formed in a cam shaft supporting portion 112 of the cylinder head 110. Here, the port of the communication hole 34 at the side of the refuge hole 33 is so arranged that it can be shut by a skirted portion 82 of the locking pin 80 when the locking pin 80 is moved against the urging force of the spring 91 by the working oil which is supplied to the fitting hole 22 via the passage 23. On the other hand, the plug 92 is prevented from coming out by the timing pulley 60.

The locking pin 80 is provided with the head portion 81 having a curved (or spherical) shape and the skirted portion 82, at which it is fitted in the refuge hole 33 with a predetermined leakage clearance so as to move radially of the external rotor 30, and is urged toward the internal rotor 20 by the spring 91. One end of the spring 91 is contacted with the plug 92. This enables the working oil to flow through the leakage clearance between the skirted portion 82 of the locking pin 80 and the refuge hole 33. If the port of the communication hole 34 at the refuge hole 33 is shut by the skirted portion 82 of the locking pin 80, the working oil flows from the fitting hole 22 to the communication hole 34 and the back pressure chamber R3 is completely closed.

The valve timing control device thus constructed according to this embodiment is held in the locked state, where the internal combustion engine is stopped to stop the oil pump and to hold the change-over valve 100 in the state of FIG. 1 and where the head portion 81 of the locking pin 80 is fitted by a predetermined stroke into the fitting hole 22 to regulate the relative rotations of the internal rotor 20 and the external rotor 30, as shown in FIGS. 2 and 3, because the working oil is not supplied from the change-over valve 100 to the advance passage 11 of the cam shaft 10 even if the internal combustion engine is started to drive the oil pump but the solenoid 103 of the change-over valve 100 is deenergized substantially simultaneously with the start of the internal combustion engine. Here, even if the locking pin 80 is unable to come into the fitting hole 22 at the stop of the internal combustion engine by the misalignment of the refuge hole 33 and the fitting hole 22, the external rotor 30, the timing pulley 60 and so on are rotated clockwise of FIG. 2 because the pressure of the working oil of the advancing chambers R1 and the delaying chambers R2 is low at the start of the internal combustion engine, so that the internal rotor 20, the vanes 70 and so on are relatively rotated to the delay side to take the most delayed position whereas the locking pin 80 is pushed into the fitting hole 22 by the spring 91.

When the solenoid 103 of the change-over valve 100 is switched from the energized state to the deenergized state while the internal combustion engine is being run to drive the oil pump, on the other hand, the working oil is supplied from the change-over valve 100 to the advance passage 11 of the cam shaft 10 so that it is supplied via the passage 42 and the individual passages 24 to the individual advancing chambers R1, and from the passage 42 via the passage 23 to the fitting hole 22. At the same time, the working oil is discharged to the outside from the individual delaying chambers R2 via the individual chambers 25, the delay passage 12, the change-over valve 100 and so on.

Figure 4:
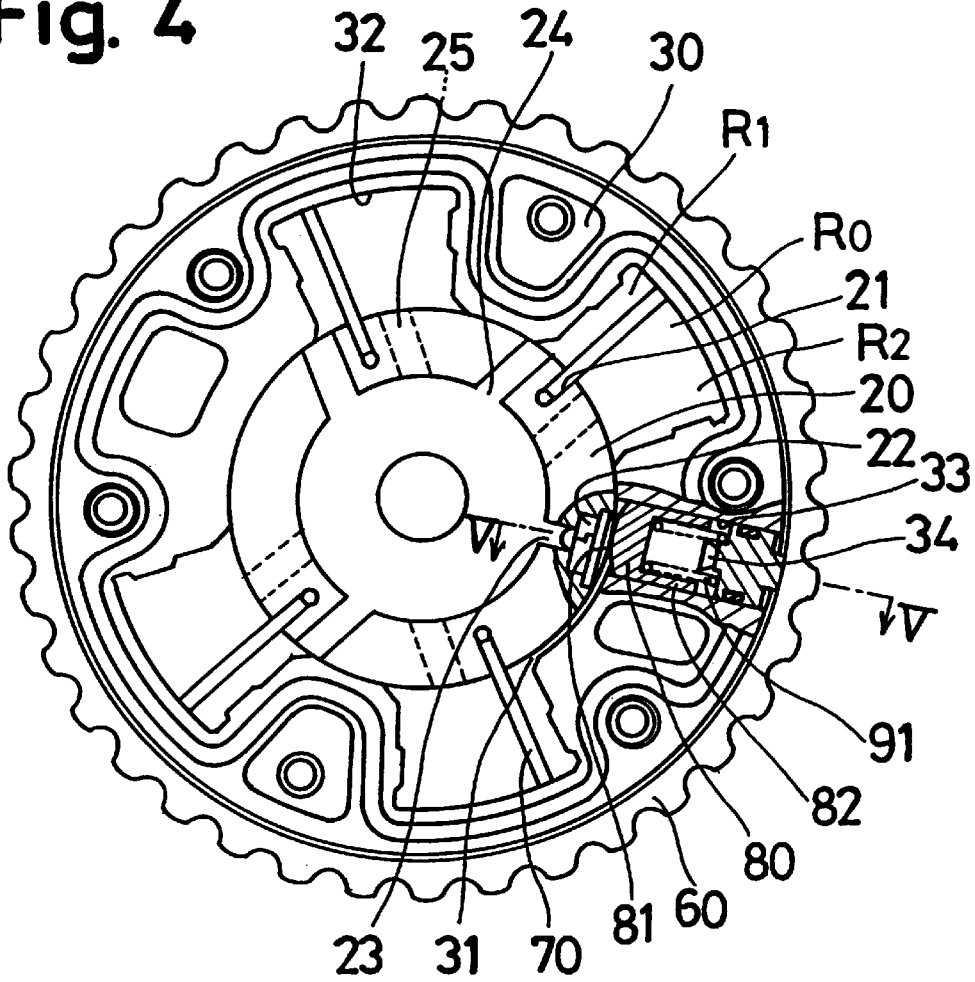
Figure 5:
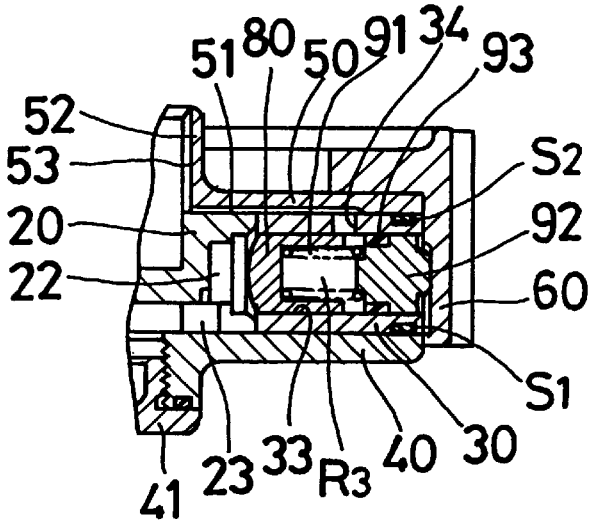
FIG. 5 is a section taken along the line V—V in FIG. 4.

Here, as the working oil supplied to the fitting hole 22 pushes the locking pin 80 against the action of the spring 91, the locking pin 80 sequentially comes out of the fitting hole 22, and a rotary shaft assembly including the cam shaft 10, the internal rotor 20 and the vanes 70 rotate relative to the rotation transmitting member including the external rotor 30 and the timing pulley 60, as shown in FIGS. 4 and 5. On the other hand, the working oil supplied to the fitting hole 22 is supplied to the advancing chamber R1, as located at the right-hand lower side, via the passage 31 formed in the external rotor 30.

In the state where the curved head portion 81 of the locking pin 80 is partially fitted in the fitting hole 22, as shown in FIGS. 4 and 5, the rotary shaft assembly including the cam shaft 10, internal rotor 20 and the vanes 70 are allowed to rotate relative to the rotational transmitting member including the external rotor 30 and the timing pulley 60, so that the relative rotations of the rotary shaft assembly and the rotational transmitting member are started before the entirety of the head portion 81 of the locking pin 80 comes out of the fitting hole 22. As a result, the timing period from the inflow of the working oil into the fitting hole 22 to relative rotations of the rotary shaft assembly and the rotational transmitting member can be shortened to improve the working response of the device.

In the state where the head portion 81 of the locking pin 80 is partially fitted in the fitting hole 22, as shown in FIGS. 4 and 5, the locking pin 80 can be pushed to quickly come out of the fitting hole 22 not only by the working oil supplied to the fitting hole 22 but also by a component of the acting force, which is established by the relative rotations of the rotary shaft assembly and the rotational transmitting member and received by the locking pin 80. As a result, the working response of the device can also be improved to make a change in quick response from the state (or the most delayed state) shown in FIGS. 2 and 3 through the state shown in FIGS. 4 and 5 to the state (or most advanced state) shown in FIGS. 6 and 7.

Figure 6:
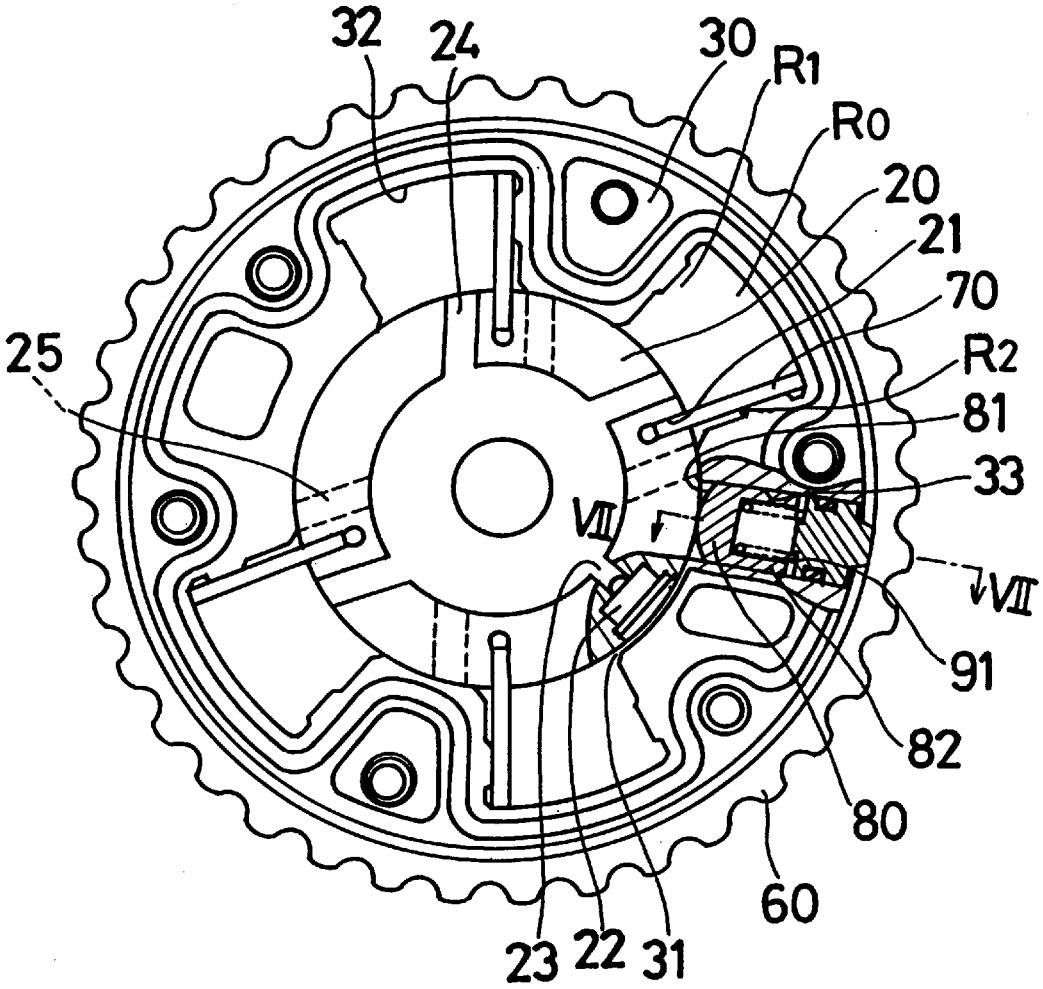
Figure 7:
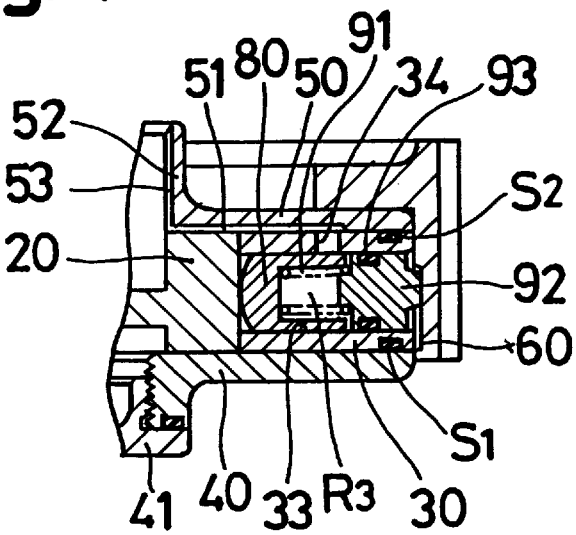
FIG. 7 is a section taken along the line VII—VII in FIG. 6.

When the solenoid 103 of the change-over valve 100 is switched in the state of FIGS. 6 and 7 from the energized state to the deenergized state, the working oil is supplied from the change-over valve 100 to the delay passage 12 of the cam shaft 10 so that it is supplied via the individual passage 25 to the individual delaying chambers R2 and is discharged to the outside from the individual advancing chambers R1 via either the individual passages 24 or the passage 31, the fitting hole 22, the passage 23, the advance passage 11, the change-over valve 100 and so on. As a result, the rotary shaft assembly including the cam shaft 10, the internal rotor 20 and the vanes 70 rotates relative to the rotational transmitting member including the external rotor 30 and the timing pulley 60 to bring the state from the one shown in FIGS. 6 and 7 to the one shown in FIGS. 2 and 3.

Here, in this embodiment, the outer end of the refuge hole 33 is closed liquid-tight by the plug 92 and the seal member 93. The working oil having leaked into the back pressure chamber R3 through the clearance between the refuge hole 33 and the locking pin 80 can be discharged into the cylinder head 110 via the communication passages (i.e., the communication hole 34 formed in the external rotor 30, the communication grooves 51 and 53 formed in the rear plate 50, and the communication hole 113 formed in the cam shaft supporting portion 112 of the cylinder head 110.) This discharge makes it possible to suppress such a poor engagement between the timing pulley 60 and the timing belt 55 and such a premature deterioration of the same belt as might otherwise be caused by the wetting of the leaked working oil. Since the aforementioned communication passages can provide the shortest communication between the back pressure chamber R3 and the inside of the cylinder head 110, moreover, the passage resistance can be so lowered as to discharge the working oil having leaked into the back pressure chamber quickly and properly into the cylinder head 110, thereby optimizing the unlocking action of the locking pin 80.

Since the working oil under pressure is not supplied to the inside of the pressure chamber R3, on the other hand, the malfunction and the fine vibration of the locking pin 80 can be eliminated to tune the lock timing of the locking pin 80 by changing the force of the spring 91 for urging the locking pin 80. In this embodiment, moreover, the working oil is discharged via the communication groove 53 which is formed in the inner circumference of the boss portion 52 of the rear plate 50, so that the outer circumference of the cam shaft 10 and the inner circumference of the boss portion 52 of the rear plate 50 can be properly lubricated with that lubricating oil. Even if a communication groove corresponding to the communication groove 53 is practiced by forming it in the outer circumference of the cam shaft 10 or if the clearance between the outer circumference of the cam shaft 10 and the inner circumference of the boss portion 52 is enlarged, it is possible to expect effects similar to those of the foregoing embodiment.

Further, since the port of the communication hole 34 at the side of the refuge hole 33 is arranged so that it can be shut by the skirted portion 82 of the locking pin 80 when the locking pin 80 is moved against the urging force of the spring 91 by the working oil which is supplied to the fitting hole 22 via the passage 23, the communication of the working oil between the back pressure chamber R3 and the communication passages (which includes the communication hole 34 formed in the external rotor 30, the communication grooves 51 and 53 formed in the rear plate 50 and the communication hole 113 formed in the cam shaft supporting portion 112 of the cylinder head 110) is closed. In this circumstance, if the locking pin 80 moves in the refuge hole 33 toward the fitting hole 22, the back pressure chamber R3 encounters a damper effect to prevent the locking pin 80 from moving. Therefore, the fluctuation of the working oil under pressure is not transferred from inside of the cylinder 110 to the inside of the pressure chamber R3 such that a fine vibration of the locking pin 80 does not occur. In addition, the moving speed of the locking pin 80 toward the fitting hole 22 is slowed by the damper effect such that the head portion 81 of the locking pin 80 is prevented from coming into the fitting hole 22, when the internal combustion engine rotates. As a result, in the working response of the device from the most delayed state shown in FIGS. 2 and 3 to the advanced state, the rotary shaft assembly including the cam shaft 10, the internal rotor 20 and the vanes 70 is able to rotate relative to the rotational transmitting member including the external rotor 30 and the timing pulley 60.

This embodiment has been practiced by providing the internal rotor 20 with the vanes 70 and by accommodating the locking pin 80 and the spring 91 in the external rotor 30. Besides this practice, however, the invention can also be practiced by accommodating the locking pin and the spring in the internal rotor and by providing the external rotor with the vanes.

On the other hand, the embodiment has been constructed such that the head portion 81 of the locking pin 80 assembled with the external rotor 30 in the state (or the most delayed state of FIG. 2), where the advancing chambers R1 take the minimum capacity, is fitted in the fitting hole 22 of the internal rotor 20. However, the construction can be modified such that the head portion 81 of the lock pin 80, as assembled with the external rotor 30, is fitted in the fitting hole 22 of the internal rotor 20 in the state (or the most advanced state of FIG. 6) where the delaying chambers R2 are at minimum capacity.

In this embodiment, moreover, the passage 23 for supplying and discharging the working oil to and from the fitting hole 22 is in communication with the passage 24 leading to the advancing chambers R1. In this device, from the most delayed state to the advanced state, the response to the head portion 81 of the locking pin 80 coming into the fitting hole 22 is easier than that of the above described embodiment. However, when the internal combustion engine rotates, the damper effect which is above described slows the moving speed of the locking pin 80 toward the fitting hole 22 such that the head portion 81 of the locking pin 80 is prevented from coming into the fitting hole 22 so as to rotate between the rotary shaft assembly, including the cam shaft 10, the internal rotor 20 and the vanes 70, and the rotational transmitting member, including the external rotor 30 and the timing pulley 60.

What is claimed is:

1. A valve timing control device comprising:

a valve opening and closing rotary shaft assembly rotatably assembled within a cylinder head of an internal combustion engine;

a rotational transmitting member mounted around the peripheral surface of the rotary shaft assembly so as to rotate relative thereto within a predetermined range for transmitting a rotational power from a crank shaft via a timing belt that is made of a resin or a rubber;

a vane provided on one of the rotary shaft assembly and the rotational transmitting member;

a chamber formed between the rotary shaft assembly and the rotational transmitting member, and divided into an advancing chamber and a delaying chamber by the vane;

a first fluid passage for supplying and discharging a fluid to and from the advancing chamber;

a second fluid passage for supplying and discharging a fluid to and from the delaying chamber;

a refuge hole formed in one of the rotational transmitting member and the rotary shaft assembly for accommodating therein a locking pin spring-biased toward the other of the rotary shaft assembly and the rotational transmitting member;

a fitting hole formed in the other of the rotary shaft assembly and the rotational transmitting member for fitting therein a head portion of the locking pin when the rotary shaft assembly and the rotational transmitting member are synchronized in a predetermined relative phase;

a third passage for supplying and discharging a fluid to and from the fitting hole; a back pressure chamber formed in the refuge hole at the back of the locking pin in communication with the inside of the cylinder head of internal combustion engine via a communication passage formed in the rotational transmitting member or the rotary shaft assembly; and closing means for closing the communication passage when the head portion of the locking pin moves into the refuge hole by the fluid supplied to the fitting hole via the third passage.

2. A valve timing control device according to claim 1, wherein the closing means includes a skirt portion of the locking pin closing one end of the communication passage.

3. A valve timing control device according to claim 2, wherein the rotary shaft assembly includes a cam shaft rotatably supported by the cylinder head, and an internal rotor integrally mounted on the leading end portion of the cam shaft;

the rotational transmitting member includes an external rotor for accommodating the internal rotor, a front plate, a rear plate, and a timing pulley integrally mounted on the outer circumference of the external rotor;

the refuge hole is formed in the external rotor;

the rear plate is rotatably supported at its inner circumference by the cam shaft; and the communication passage includes a first passage formed in the external rotor for communicating with the back pressure chamber, a second passage formed between the external rotor and the rear plate for communicating with the fist passage, and a third passage formed between the rear plate and the cam shaft for providing communication between the second passage and the inside of the cylinder head.

* * * * *